US009222261B2

(12) United States Patent
Weeks

(10) Patent No.: US 9,222,261 B2
(45) Date of Patent: Dec. 29, 2015

(54) PREFABRICATED STRUCTURAL BUILDING FRAME AND METHOD OF MAKING THE SAME

(75) Inventor: Kevin Weeks, Adelaide (AU)

(73) Assignee: Weeks Holdings Pty Ltd, Elizabeth, South Australia (AU)

( * ) Notice: Subject to any disclaimer, the term of this patent is extended or adjusted under 35 U.S.C. 154(b) by 0 days.

(21) Appl. No.: 13/380,818

(22) PCT Filed: Jul. 7, 2010

(86) PCT No.: PCT/AU2010/000869

§ 371 (c)(1), (2), (4) Date: Dec. 24, 2011

(87) PCT Pub. No.: WO2011/003143

PCT Pub. Date: Jan. 13, 2011

(65) Prior Publication Data

US 2012/0096785 A1 Apr. 26, 2012

(30) Foreign Application Priority Data

Jul. 7, 2009 (AU) ..... 2009903167

(51) Int. Cl.

| | |
|---|---|
| ***E04C 2/08*** | (2006.01) |
| ***E04C 2/38*** | (2006.01) |
| ***E04B 1/08*** | (2006.01) |
| ***E04C 2/22*** | (2006.01) |

(52) U.S. Cl.

CPC . *E04C 2/386* (2013.01); *E04B 1/08* (2013.01); *E04C 2/22* (2013.01); *E04C 2/384* (2013.01)

(58) Field of Classification Search

USPC ..... 52/220.2, 309.7, 309.16, 653.1, 745.19

See application file for complete search history.

(56) References Cited

U.S. PATENT DOCUMENTS

| | | | | |
|---|---|---|---|---|
| 4,856,244 | A * | 8/1989 | Clapp | 52/309.7 |
| 5,943,775 | A * | 8/1999 | Lanahan et al. | 29/897.32 |
| 6,026,629 | A * | 2/2000 | Strickland et al. | 52/794.1 |
| 6,167,624 | B1 * | 1/2001 | Lanahan et al. | 29/897.32 |
| 6,272,447 | B1 * | 8/2001 | Gavin et al. | 703/1 |
| 7,130,775 | B2 * | 10/2006 | Takagaki et al. | 703/1 |
| 7,168,216 | B2 * | 1/2007 | Hagen, Jr. | 52/480 |
| 7,574,837 | B2 * | 8/2009 | Hagen et al. | 52/404.1 |
| 7,790,302 | B2 * | 9/2010 | Ladely (Guevara) et al. | 428/703 |
| 7,835,810 | B2 * | 11/2010 | Mifsud et al. | 700/98 |
| 7,894,920 | B2 * | 2/2011 | Mifsud et al. | 700/95 |
| 8,161,699 | B2 * | 4/2012 | LeBlang | 52/309.12 |
| 2009/0113820 | A1 * | 5/2009 | Deans | 52/169.14 |

FOREIGN PATENT DOCUMENTS

| | | | | |
|---|---|---|---|---|
| JP | 2001027032 A * | 1/2001 | | E04F 13/08 |

* cited by examiner

*Primary Examiner* — Elizabeth A Plummer
(74) *Attorney, Agent, or Firm* — Sand & Sebolt

(57) ABSTRACT

Building design data is input into a computer to make a series of wall frames for a building. Operational instructions from the computer are used to fabricate members of the frames, fill the frames with insulating material and apply and external waterproof coating.

12 Claims, 6 Drawing Sheets

PREFABRICATED STRUCTURAL BUILDING FRAME AND METHOD OF MAKING THE SAME

The present invention relates to prefabricated structural building frames and, in particular, to foam-filled exterior wall frames for a building structure such as a house, each wall frame including interior service channels and a coated exterior surface. The present invention also relates to a method of manufacturing the frames in accordance with building design data.

BACKGROUND OF THE INVENTION

The present Applicant is the inventor of technology relating to the production of steel framework for houses, in particular, steel wall frames, roof trusses, and the like. In particular, the technology involves inputting data relating to the design of a building structure, such as a home, into a computer program and translating that data into a series of roll forming and cutting operations to thereby produce each of the structural elements which make up the wall or roof truss layout. The data takes into account, amongst other factors, wall height and length, window and door locations, and the position of service locations such as lights and power points which require apertures being formed in the structural elements at different locations depending on the design.

Each of the roll forming machines includes a labelling means for labelling each structural element with computer coded profiles according to their required position in a frame. This facilitates manual assembly of the wall frames and roof trusses after the roll-forming and cutting operations. Once each frame is assembled, they are flat packed and transported to a building site where they are erected into wall, truss and joist panels with minimal skill being required. For example, it takes three workers only a few days to erect a typical 180 $m^2$ home.

The use of polystyrene foam in association with frames for the purpose of insulation is not new, nor is the use of polystyrene as a wall cladding system. For example, some systems utilise polystyrene insulation panels secured to exterior wall surfaces of a building structure using mechanical fixing means, the foam providing a surface for the application of a coating material such as render. There are however a number of problems associated with existing systems such as these, including:

- they are expensive and labour intensive in that the foam is typically manufactured in panels and, as with the frames, require onsite assembly;
- as mentioned above, the panels are secured to exterior wall surfaces using mechanical fixings which are not only expensive and labour intensive to install, but the end result is an uneven foam surface with exposed metal which does not facilitate the application of an external coating material; and
- the foam is typically of a low density, and is either mounted to a supporting structure, is panelised to fit around stud elements, or includes cutouts for receiving stud elements, thereby not contributing to the frame's structural rigidity and integrity.

Furthermore, there are no frame manufacturing systems known to the Applicant for producing finished foam-filled frames quickly and inexpensively off site and which require only minimal skill to erect once transported onsite. Nor are there frame systems known to the Applicant whereby finished foam-filled frames are produced in accordance with input design data relating to a building structure.

It is therefore an object of the present invention to overcome at least some of the aforementioned problems or provide the public with useful alternatives.

SUMMARY OF THE INVENTION

Therefore in one form of the invention there is proposed a prefabricated building frame characterised by:

structural frame elements;

expanded polystyrene foam moulded between said structural elements, said foam extending to a depth greater than said structural elements on at least one side of the frame to thereby form a foam facade; and a coating applied to said foam facade.

Preferably said building frame is a wall frame and said coating is in the form of a waterproof render adapted to form the external surface of the wall frame.

Preferably said waterproof render includes a first layer of base render, a fibreglass mesh, a second layer of base render, and an external texture coating.

In preference said structural elements include a plurality of horizontal beams and vertical studs each having web and flange portions.

In preference at least one of said frame elements includes one or more apertures extending through web portions thereof at predefined locations to accommodate services such as electrical wiring.

Preferably on the opposed side of the foam facade, said frame includes cut-outs in the foam adapted to define a path for said services.

In a further form of the invention there is proposed a prefabricated frame for a building structure such as a house, said frame characterised by:

structural frame elements including a plurality of horizontal beams and vertical studs each having web and flange portions, said frame elements including apertures extending through said web portions at predefined locations to accommodate services, such as electrical wiring;

a high density, insulating filler material moulded between said frame elements, said filler material including service cut-outs on one side of the frame which define a path for said services.

Preferably said filler material is expanded polystyrene foam.

In preference said prefabricated frame is an external wall frame of the building structure.

Preferably said wall frame includes an additional layer of filler material extending out from one side of said frame to a depth greater than that of said structural elements, said additional layer providing a smooth facade for receiving a coating material.

Preferably said coating material includes a first layer of base render, a fibreglass mesh, a second layer of base render, and an external texture coating.

In a still further form of the invention there is proposed a building structure including a plurality of prefabricated frames as characterised above.

In a yet further form of the invention there is proposed a method of producing a finished wall frame for a building structure characterised by the steps of:

assembling a plurality of structural elements to form a wall frame;

filling said frame with expanded polystyrene foam to a depth greater than that of the structural elements on one side of the wall frame, to thereby form a foam facade having no exposed metallic surface;

applying a weatherproof finishing material to said foam facade such that said facade is suitable as an external surface of said building structure.

Preferably the method includes the further step of cutting service cut-outs into the foam on the opposite side of the frame for accommodating services such as electrical wiring.

In a still further form of the invention there is proposed a method of producing prefabricated frames for a building structure such as a house, including the steps of:

inputting data relating to a design of the structure into a computer program which translates the design data into designs of a plurality of separate frames that have the correct size and shape to be assembled together to complete the structure, and produce operational instructions for roll-forming strip and cutting the roll-formed strip into structural elements;

roll-forming and cutting the strip in accordance with said operational instructions; assembling the frames;

filling the frames with a high density insulating material, such as expanded polystyrene foam to a depth greater than the structural elements on at least one side of each frame to thereby form a metal-free foam facade; and applying a weatherproof coating to said foam facade.

Preferably said operational instructions further include instructions for cutting service apertures in the structural elements.

In preference said method further includes the step of providing service apertures in the strip in accordance with said operational instructions.

Preferably said operational instructions further include instructions for forming service cutouts in said foam on the opposite side to said foam facade.

In preference said method includes a further step of forming said service cutouts in said foam in accordance with the operational instructions.

In a yet further form of the invention there is proposed a method of producing prefabricated frames for a building structure such as a house, including the steps of:

inputting data relating to a design of the structure into a computer program which translates the design data into designs of a plurality of separate frames that have the correct size and shape to be assembled together to complete the structure, and produce operational instructions for roll-forming strip, cutting the roll-formed strip into structural elements, and cutting service apertures in the structural elements;

roll-forming, cutting and providing service apertures in the strip in accordance with said operational instructions;

assembling the frames; and filling the frames with a high density insulating material, such as expanded polystyrene foam.

Preferably said computer program further produces operational instructions for forming service cutouts in said foam on one side of said frame.

In preference said method includes a further step of forming said service cutouts in accordance with the operational instructions.

Preferably said step of filling the frames with high density insulating material involves filling the frames to a depth greater than the structural elements on the opposite side of the frame to that of the service cut-outs to thereby provide a smooth facade.

In preference said method includes the further step of applying a coating material to said smooth facade.

Preferably said coating material includes a first layer of base render, a fibreglass mesh, a second layer of base render, and an external texture coating.

In a further form of the invention there is proposed a method of manufacturing a prefabricated wall frame for a house including the steps of:

inputting data relating to a design of the house into a computer program which translates the design data into designs of a plurality of separate wall frames that have the correct size and shape to be assembled together to complete the building of the house, and produce operational instructions for roll-forming strip and cutting the roll-formed strip into structural elements, cutting service apertures in the structural elements, cutting service channels into the frame, filling the frame with expanded polystyrene foam, applying an additional layer of foam and a coating material;

roll-forming, cutting and providing service apertures in the strip in accordance with said operational instructions to form the structural elements forming part of each frame;

assembling the frames;

filling the frames with expanded polystyrene foam in accordance with said operational instructions;

cutting service channels into the foam in accordance with said operational instructions; applying an additional layer of foam to one side of frames which are identified as being external wall frames of the house in accordance with the operational instructions to thereby form a smooth external facade; and applying said coating material to the external facade in accordance with the operational instructions.

In a still further form of the invention there is proposed a prefabricated frame manufactured in accordance with any one of the above methods.

In a yet further form of the invention there is proposed a building structure including a plurality of wall frames manufactured in accordance with any one of the above methods.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
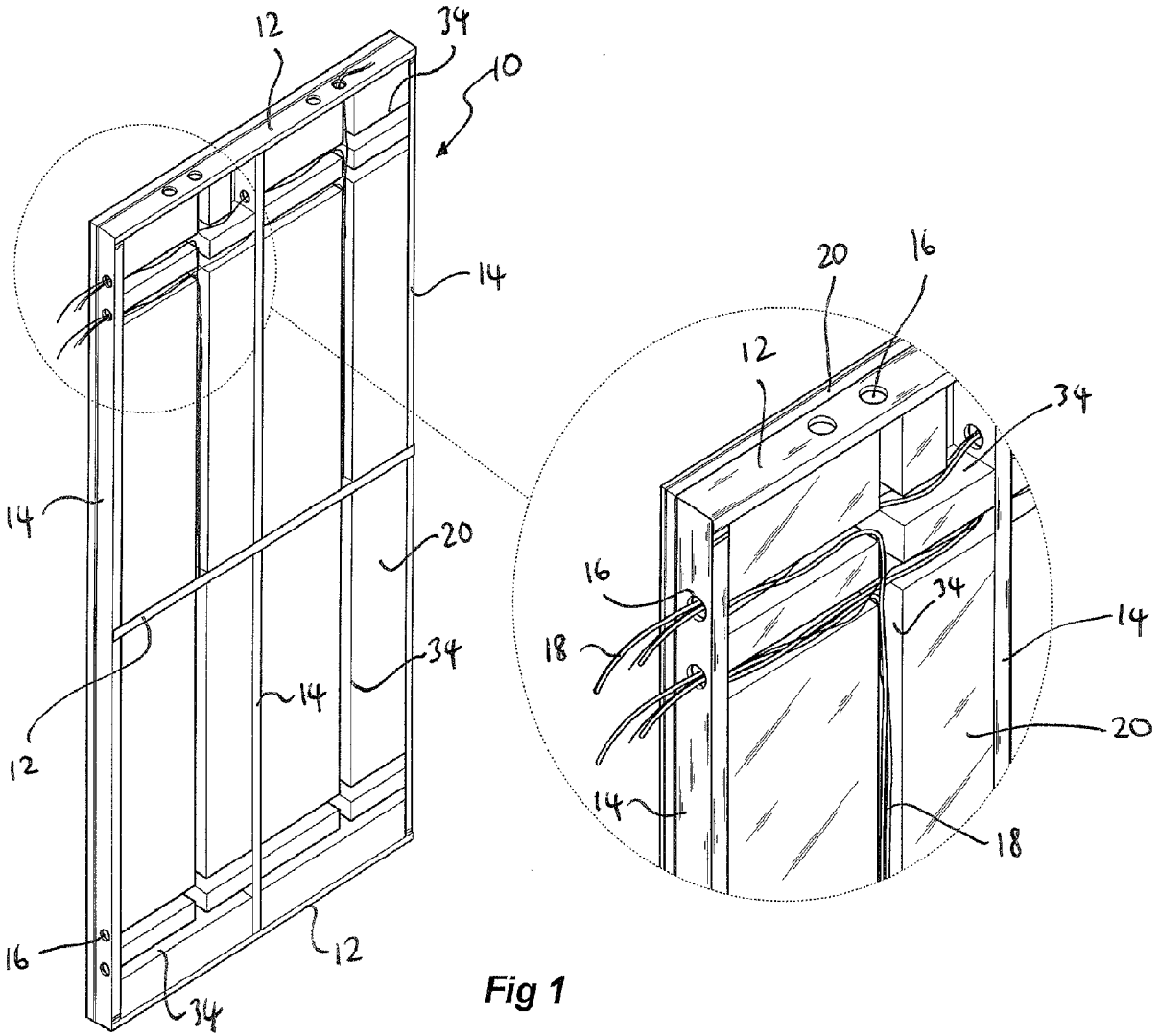
FIG. 1 illustrates a rear perspective view of a prefabricated building frame in accordance with the present invention, including an enlarged perspective view of top corner of the frame.

The present invention relates to a prefabricated foam-filled building frame 10 and a method of producing such frames. FIG. 1 illustrates an example of a wall frame 10 of the present invention. The wall frame 10 exemplified is for a basic wall structure and may for example form a smaller exterior wall having no doors or windows. This basic frame 10 is shown and described herein for the purpose of brevity and for understanding of the present invention, however, it is to be understood that the word "frame" herein may also encompass within its scope alternately configured frames. For example, the frame could be taller than frame 10 embodied herein, and could well span the entire length of a house for example, and would include a door and/or windows (not shown). Such a frame would include structural elements to accommodate the door and windows, for example, shorter studs above and below the windows, and above the door.

Also, whilst the present invention is directed primarily to wall frames and their manufacture, there is no reason why such frames could not be used as floor frames or roof trusses. The present invention is not intended to be limited to any one application.

Figure 2:
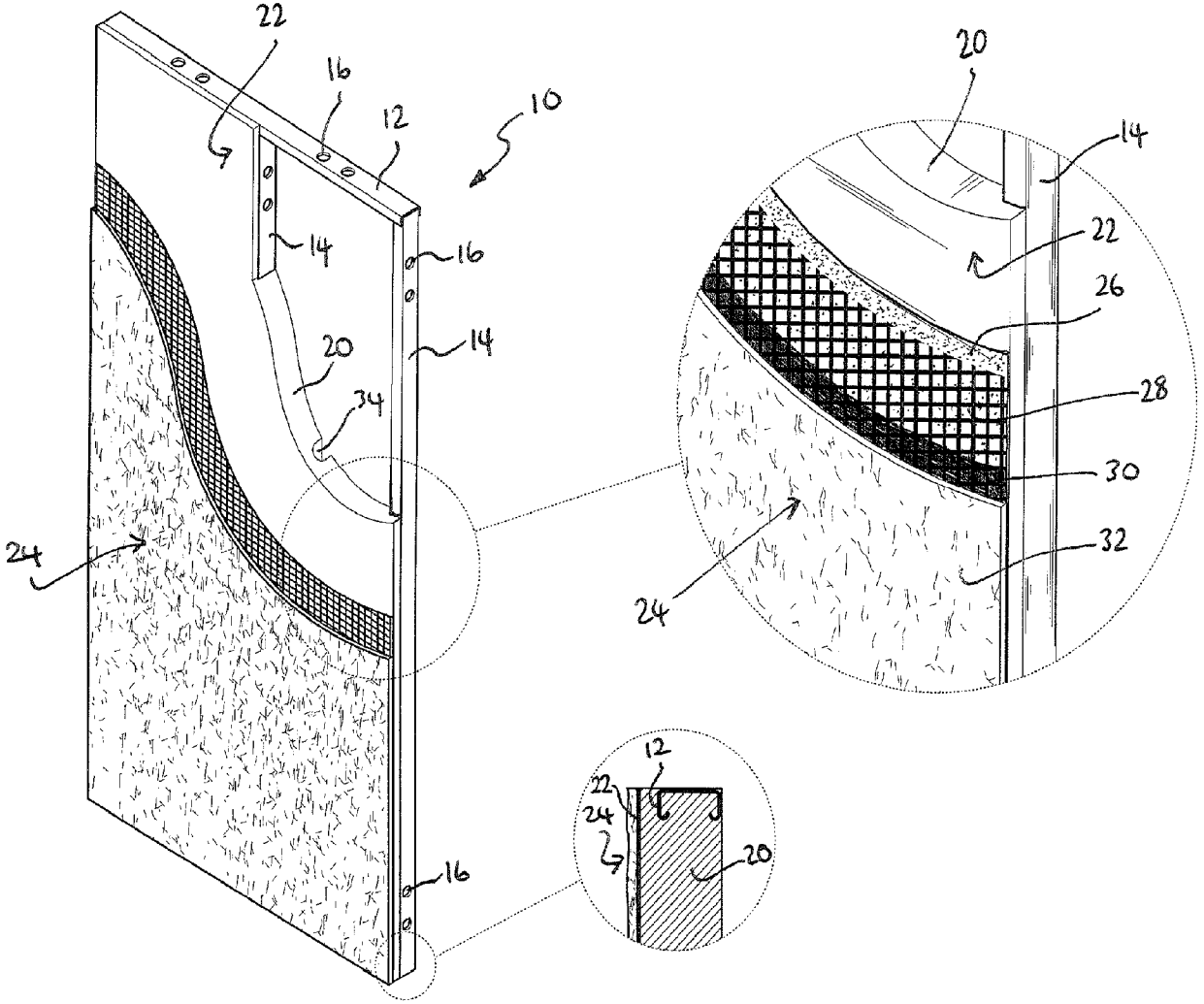
FIG. 2 illustrates a partially cutaway, front perspective view of the prefabricated building frame of FIG. 1, including an enlarged perspective view of the front side of the frame, and an enlarged side cross sectional view of the bottom edge.

Referring to FIGS. 1-2, the frame 10 includes a plurality of steel frame elements which form a substantially rectangular structure, including horizontal C-section beams 12, vertical C-section studs 14, and noggings (not shown) which extend horizontally between the studs 14. Each of the elements 12 and 14 includes, at predetermined locations, apertures 16 for allowing services such as electrical wiring 18 access into the frame 10, and also through structural elements inside the frame 10. The length of each structural element, and the location of each aperture 16 will vary depending on the design of the desired structure to be built, this being described in more detail below.

Each frame 10 is filled with an insulating/structural material, in the embodiment shown being a high density, expanded polystyrene (EPS) foam 20. As will be described in more detail below, the foam 20 is injected or sprayed inside the assembled frame 10 and bonds to the various structural elements as it hardens, the end result being a structural steel frame having an integrally moulded foam core. The foam 20 is applied to a depth greater than the frame on one side, this side adapted to form the external side of the frame. The result is a smooth, flat foam facade 22 without any metal exposed. Those skilled in the art would realise that such a facade 22 will facilitate the application of a coating material 24. No mechanical fixings are therefore required to fix the foam 20 to the structural elements.

The coating material 24 may be any suitable coating material, however, the coating material 24 preferably includes a first layer of base render 26 to be applied directly to the facade 22, followed by a fibreglass mesh 28, then a second layer of base render 30, and finally an external texture coating 32. The facade 22 is smooth and flat, and there are no exposed metal surfaces or fixings, which means the render can be applied uniformly and without the need for re-application.

Already, one can appreciate that a wall frame having undergone the processes described is ready for erection at a building site in that it includes all the structural elements required by a wall frame, insulation is moulded into the frame, and a finished external surface is present in the form of an additional layer of foam finished with a waterproof render. The fact that this frame is manufacturable to this form offsite means that far less materials and skilled labour are required onsite when assembling a building structure.

On the opposite side of the frame 10, the foam may include cut-outs 34 which extend from the service apertures 16 in the outer frame elements to wherever a particular service is required along the wall, or as shown, they can extend all the way to the opposite edge of the frame 10. Because gyprock (not shown), or other internal wall lining material, is adapted to line the inside of the frame 10, there needs to be a way of accommodating the services and the cut-outs 34 to provide a path for services to run through. Although not shown, tubing could be inserted into the cut-outs 34 to house electrical wiring and the like.

The frame 10 of the present invention therefore provides, in broad terms, a high density EPS foam-filled frame structure, the foam providing structural rigidity to the frame as well as providing a facade 22 on one side thereof which facilitates the application of a coating material 24. In a preferred form of the invention, the frame 10 is an external wall structure of a house, the coating material is a render material as embodied herein adapted to face the exterior of the house, and the inside surface of the foam includes a web of cut-outs 34 for accommodating services required through the frame. The skilled addressee would realise the practicality and cost savings in being able to receive such a prefabricated frame on site and simply erecting it.

Figure 3:
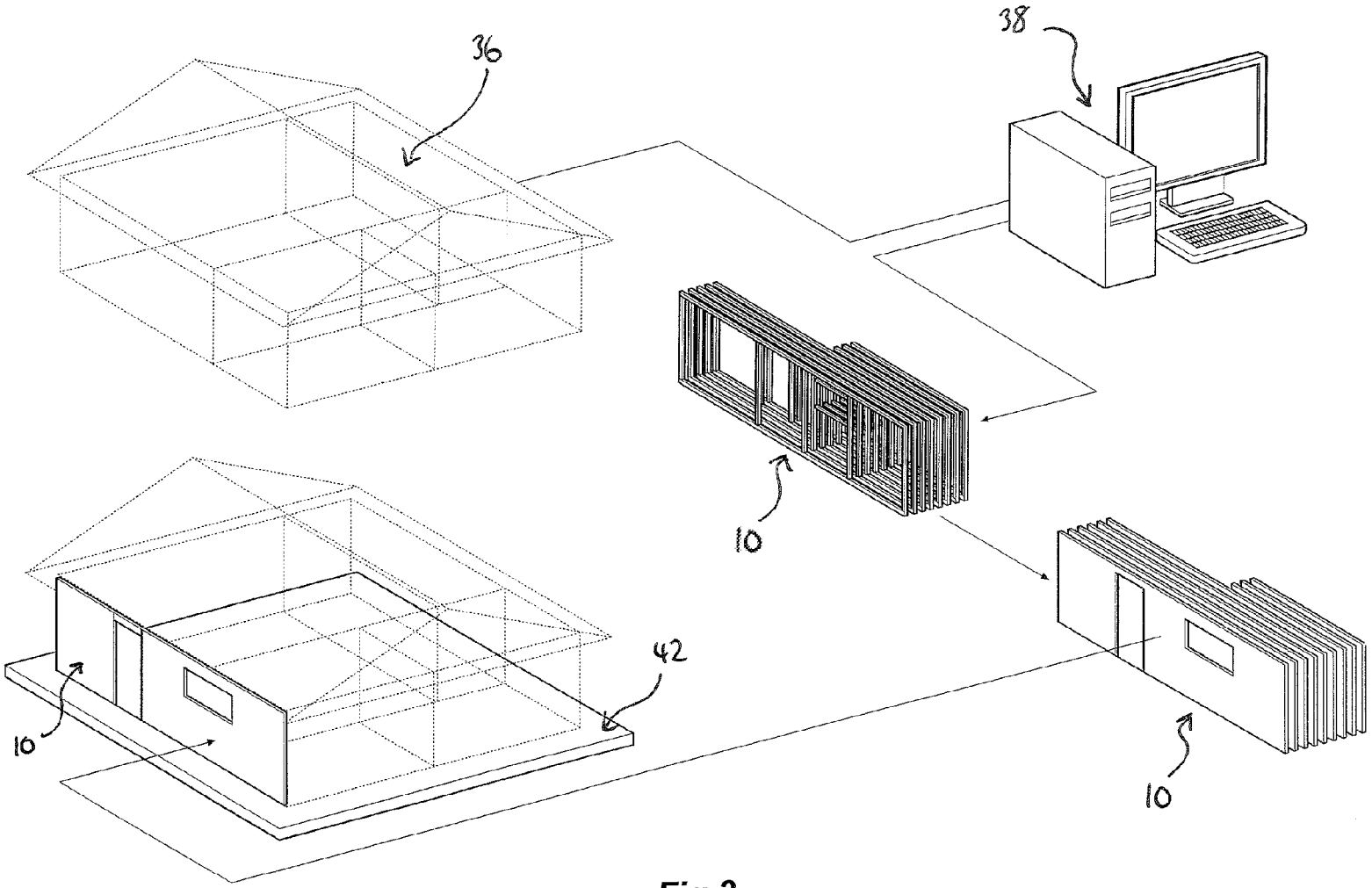
FIG. 3 illustrates schematically a method of manufacturing the prefabricated structural building frames in accordance with the present invention, including inputting structural data into a computing means, assembling frames in accordance with the structural data; foam-filling, coating and providing service channels in the frame, and transporting the frames onsite for assembly; and FIGS. **4*a*-4*c*** illustrate progressively the steps of injecting foam into the frame and forming an exterior façade, coating the exterior façade, and providing channels to the interior of the frame to accommodate services.

The present invention also relates to a method of manufacturing the prefabricated frames 10 described above. FIG. 3 illustrates schematically the following steps according to a preferred embodiment:

1) Inputting data relating to the design of a structure to be built 36 into a computing means or computer program 38 which translates that data into operational instructions for roll-forming and cutting machines (not shown) to produce a plurality of individual structural elements for the structure 36 in accordance with the data;
2) Assembling the structural elements to form frames 10 of the structure 36, including wall frames;
3) Filling the frames 10 with foam 20, where required in accordance with the input data, to a depth that is greater on one side of the frame than that of the structural elements to thereby form a foam facade 22;
4) Applying an external coating material 24 to the foam facade 22; and
5) Providing internal service cut-outs 34 where required on the internal side of the frames, in accordance with the input data, thereby finalising manufacture of the prefabricated frames 10 which are now ready to be transported to the building site 42 and erected.

Figure 4A:
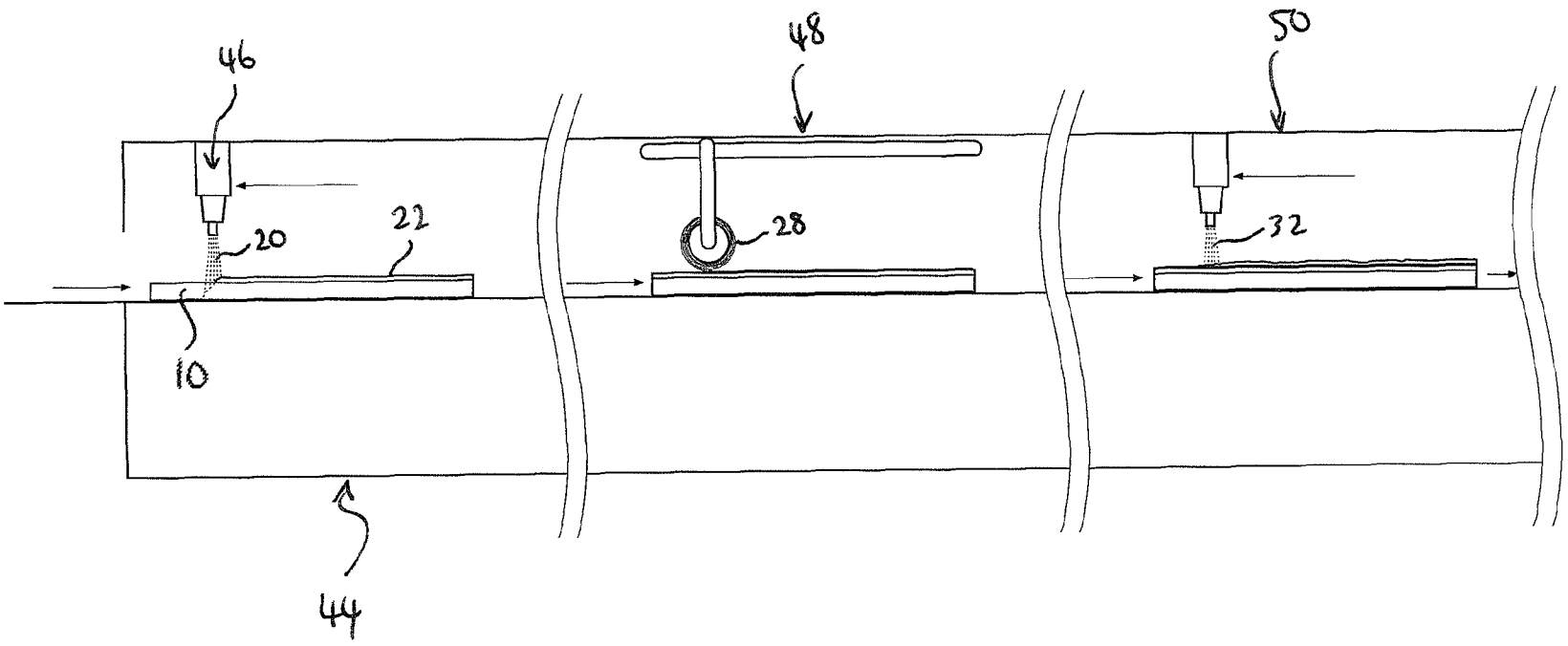
Figure 4B:
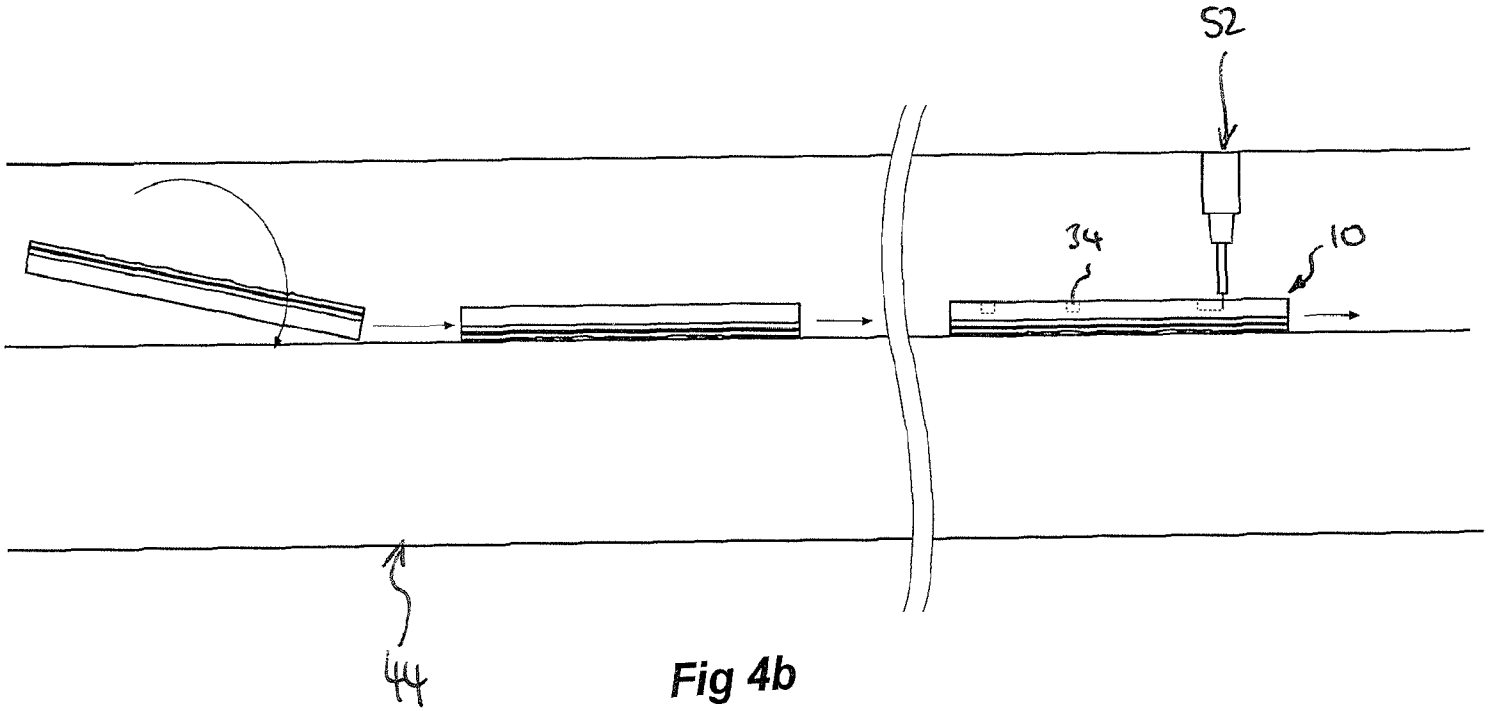
Figure 4C:
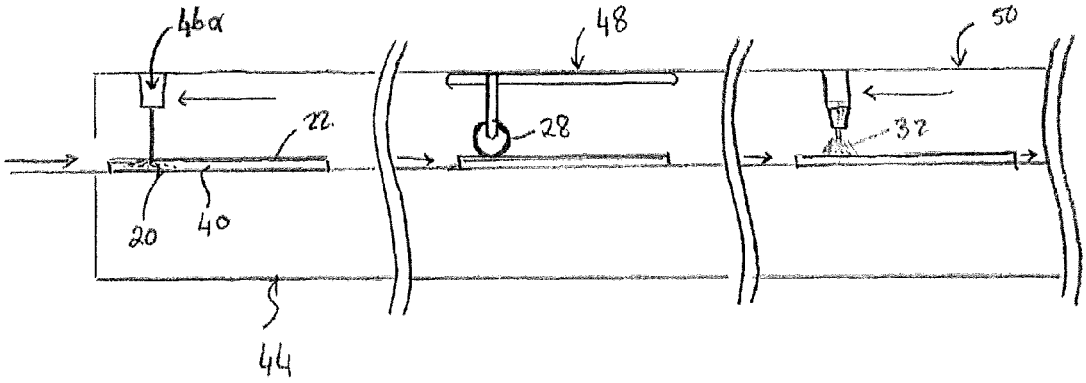

FIGS. 4*a*-4*c* illustrate one embodiment of how steps 3-4 above can be performed. An assembled frame 40 is shown which includes assembled structural elements, as well as service apertures 16 formed in each of the elements. The dimensions of the frame 40, the positioning of the doors and windows, and the location of the service apertures 16 in the structural elements are all in accordance with the design data input into the computer 38. It is this frame 40 which is subjected to a series of operations. In the embodiment shown, the operations are performed above a conveying machine 44 which transports the frame 40 in a controlled manner through the series of operations which will now be described.

Firstly, the inside of the frame is sprayed (FIG. 4*a*) or injected (FIG. 4*c*) with expanded EPS foam 20, or other suitable structural/insulation material, using an appropriate injection means 46*a* (FIG. 4*c*) or spray means 46 (FIG. 4*a*) to a depth above that of the frame 40 (approximately a few centimeters) to thereby form an exterior façade 22. Once the foam hardens, it becomes integrally moulded with the frame structural elements.

The conveyor machine 44 is then used to transport the frame to a render and fibreglass mesh applicator 48 which coats the facade 22 with the layers 26, 28 and 30 described earlier, and then to a final external texture coating applicator 50 for finishing the exterior of the wall frame 10. No additional coatings need to be applied to the exterior facade onsite, except perhaps a coat of paint, but even paint could be applied offsite in a further step.

Finally, the frame is turned by 180 degrees and the cut-outs 34 for accommodating services are formed in the foam 20 using a cutting means 52. Alternatively, the frame needn't be turned and the cutting means could be configured to cut into the foam from the underside. In the embodiment shown, the cutting means 52 is an automated hot melt cutting machine.

The final product is a finished prefabricated frame 10 which is ready to be flat packed together with other frames forming the building structure 36 and transported to site 42 to be erected. Minimal additional work needs to be done to the frame beyond this point.

In preference, operation of the foam injection or spray means 36, render and fibreglass mesh applicator 48, final external texture coating applicator 50, cutting means 52, and even the conveyor 44 is controlled in accordance with the input design data. The result is an almost entirely automated system of frame fabrication whereby data relating to the design of the structure to be built is input into a computer means, and this data is translated to operational data for all of the machines involved in the manufacturing process.

The skilled addressee would realise that, for example, where the frame 10 is to be an external wall frame which includes a door or window, the foam injection or spray means 36 will recognise the dimensions of the frame and the location of the door and windows and therefore will not inject foam into those areas. The same applies to the render applicators 48 and 50. In a similar manner, the cutting means 52 will recognise automatically where the service apertures 16 are located in the structural elements of the frame, and also where the services are required in the wall, and will be able to form the cut-outs 34 accordingly.

Obviously, not all frames used in the structure will require a facade 22, or a coating material 24, or service cutouts 34. Each machine will recognise this based upon the input design data and after foam has been applied, the conveyor means can simply transport the frames through without undergoing these additional processes or they can be diverted or manually removed. It is also envisaged that after the manufacturing process, each frame will be labelled and stacked in a manner which will facilitate erecting the frames once they reach the building site.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A method of producing prefabricated frames for a building, including the steps of:

inputting data relating to a design of the building into a computer program;

automatically translating the data into designs of a plurality of separate frames, the plurality of separate frames comprising a plurality of structural elements and having a size and shape to be assembled together to complete the building;

automatically producing operational instructions for roll-forming machinery and cutting machinery to fabricate the plurality of structural elements;

roll-forming a strip with the roll-forming machinery;

cutting the strip with the cutting machinery into the plurality of structural elements; wherein the steps of roll-forming and cutting the strip are accomplished in accordance with said operational instructions;

assembling the plurality of separate frames from the plurality of structural elements;

injecting the plurality of separate frames with a high density insulating foam which bonds to the plurality of separate frames as the foam hardens, to a depth greater than the plurality of structural elements on at least one side of each of the plurality of separate frames to thereby form a metal-free foam façade; and applying a weatherproof coating to said foam façade.

2. The method of producing prefabricated frames as defined in claim 1 wherein said operational instructions further include instructions for automatically cutting service apertures in the plurality of structural elements.

3. The method of producing prefabricated frames as defined in claim 1 further including the step of automatically providing service apertures in the strip in accordance with said operational instructions.

4. The method of producing frames as defined in claim 1 wherein said operational instructions further include instructions for automatically forming service cutouts in said foam on an opposite side to said foam façade.

5. The method of producing prefabricated frames as defined in claim 4 wherein said method includes a further step of automatically forming said service cutouts in said foam in accordance with the operational instructions.

6. The method of producing prefabricated frames as defined in claim 1 wherein said weatherproof coating includes a first layer of base render, a fiberglass mesh, a second layer of base render, and an external texture coating.

7. The method of producing prefabricated frames as defined in claim 1, wherein the foam façade hardens before the weatherproof coating is applied.

8. The method of producing prefabricated frames as defined in claim 1 further including flat packing the plurality of separate frames for forming the building together and transporting the plurality of separate frames to a building site.

9. The method of producing prefabricated frames as defined in claim 1, further comprising labelling each of the plurality of separate frames and stacking the plurality of separate frames in a manner which will facilitate erecting the plurality of separate frames once the plurality of separate frames reach a building site.

10. The method of producing prefabricated frames as defined in claim 1, wherein said operational instructions further include instructions for automatically applying layers that go to make up the weatherproofing coating.

11. A method of manufacturing a prefabricated wall frame for a house including the steps of:

inputting data relating to a design of the house into a computer program which automatically translates the data into designs of a plurality of separate wall frames that have a size and shape to be assembled together to complete the building of the house, which computer program automatically produces operational instructions for roll-forming a strip and cutting the strip into a plurality of structural elements, cutting service apertures in the plurality of structural elements, injecting the plurality of separate frames with expanded polystyrene foam which bonds to the plurality of separate frames as the foam hardens, to a depth greater than the plurality of structural elements on at least one side of the plurality of separate frames, cutting service channels into the foam and applying a coating material;

automatically roll-forming, cutting and providing service apertures in the strip in accordance with said operational instructions to form the plurality of structural elements that form part of each of the plurality of separate frames that is required for building the entire house;

assembling the plurality of the separate frames;

filling the frames with foam in accordance with said operational instructions to thereby form a smooth external façade;

cutting service channels into the foam in accordance with said operational instructions; and applying said coating material to the external façade in accordance with the operational instructions.

12. The method of manufacturing a prefabricated wall frame for a house as defined in claim 11, wherein the foam façade hardens before the weatherproof coating is applied.

* * * * *